United States Patent [19]

Fromknecht

[11] 4,342,132

[45] Aug. 3, 1982

[54] CARPET PILE SENSOR AND INDICATOR FOR CARPET CLEANER

[75] Inventor: Charles T. Fromknecht, Anderson, S.C.

[73] Assignee: The Singer Company, Stamford, Conn.

[21] Appl. No.: 192,777

[22] Filed: Oct. 1, 1980

[51] Int. Cl.[3] ..... A47L 5/34

[52] U.S. Cl. ..... 15/339

[58] Field of Search ..... 15/319, 339

[56] References Cited

U.S. PATENT DOCUMENTS

| | | | |
|---|---|---|---|
| 2,063,061 | 12/1936 | Sparklin | 15/339 |
| 2,343,227 | 2/1944 | Sellers et al. | 15/319 |
| 2,526,419 | 10/1950 | Reeves | 15/319 X |
| 2,592,710 | 4/1952 | Kirby | 15/319 |
| 3,909,874 | 10/1975 | Clowers et al. | 15/339 |

*Primary Examiner*—Chris K. Moore

*Attorney, Agent, or Firm*—Edward P. Schmidt; Robert E. Smith; Edward L. Bell

[57] ABSTRACT

Means is associated with a carpet cleaner, or the like, having an adjustable nozzle height providing a multiple number of nozzle height positions, for automatically sensing the pile of the floor covering being cleaned and automatically indicating the appropriate nozzle height position for any specific floor covering upon which the cleaner is positioned by automatically measuring and indicating the pile height and density of such floor covering using a pile height and density sensor which is independent of the nozzle height position, that is, which gives a uniform reading for a specific floor covering pile height and density regardless of the nozzle height setting at the time of sensing. Comprising a pile height and density sensor foot or plate pivoted to the rear wheel axle extending rearwardly therefrom past the rear wheels for sensing the height and density of the pile of the floor covering on which the cleaner rests together with a flexible connector between such sensor foot or plate and an indicator providing visual indication to an operator of the position of such sensor foot relative such rear wheel and, therefore, of the pile height and density.

12 Claims, 6 Drawing Figures

12
32
34
62
50
10
36
81
72
82
40
48
42
46
29
20
18
14

10
16
30
26
28
29
20
18
12
22
24
44
46
40
29
20
42
28
46
44
26
86
68
30
38
62
60
82
50
81
60

CARPET PILE SENSOR AND INDICATOR FOR CARPET CLEANER

DESCRIPTION

1. Field of the Invention

This invention relates to carpet cleaners and, more particularly to a carpet pile sensor and indicator for use therewith having a particular utility when applied to a vacuum carpet cleaning having means for selectively raising and lowering the suction inlet nozzle in accordance with the height and density of the pile of the carpet being cleaned.

2. Background of the Invention

Vacuum cleaners of the carpet or floor covering cleaning generally include a chassis having a nozzle at the bottom thereof through which air is sucked by a moving motor blower unit, a rotary brush mounted adjacent the nozzle for contacting the floor surface to agitate and loosen the dirt so that it may be sucked free of the surface, and wheels mounted at the front and rear of the chassis for supporting the cleaner for rolling on the floor. Since these cleaners are called upon to clean many different kinds of modern carpets or other floor covering of varying pile height, it is known to vary the chassis elevation to locate the nozzle at a level above the surface to provide proper suction and flow path for the particular type of carpet or other floor covering and to position the brush at the proper height to agitate the dirt on the surface. The many different kinds of modern floor coverings require that, for the cleaner to clean properly, a plurality of nozzle height elevations be provided.

Heretofore, although a plurality of nozzle height elevation were often provided, selection of the optimum nozzle height for a particular floor covering has been left to the experience of the operator, often with only very rough guidance from the cleaner manufacturer. Such guidance, when given, usually requires some subjective evaluation of the floor covering by the operator, usually based solely upon pile height. Yet, with the wide variety of material used for modern floor coverings, such subjective assessment of floor covering characteristics such as "low pile," "high pile," or "shag," for example, and adjustment of nozzle height based only upon subjective evaluation, do not always provide optimum penetration of the brush into the pile for optimum air flow through the nozzle.

OBJECTS OF THE INVENTION

Bearing in mind the foregoing, it is a primary object of the present invention to provide means associated with a carpet cleaner, or the like, having an adjustable nozzle height providing a multiple number of nozzle height positions, for automatically sensing the pile of the floor covering being cleaned and automatically indicating the appropriate nozzle height position for any specific floor covering upon which the cleaner is positioned.

Yet another primary object of the present invention, in addition to the foregoing object, is the provision of such means for automatically measuring and indicating the pile height and density of such floor covering.

Yet another primary object of the present invention, in addition to each of the foregoing objects, is the provision of such a pile height and density sensor and indicator which is independent of the nozzle height position, that is, which gives a uniform reading for a specific floor covering pile height and density regardless of the nozzle height setting at the time of sensing.

Yet still another primary object of the present invention, in addition to each of the foregoing objects, is the provision in a carpet cleaner having a nozzle height adjusting mechanism including rear wheels mounted on off-set ends of a rear axle formed with a central portion journalled in the rear of the chassis, of a pile height and density sensor foot or plate pivoted to such central portion or in axial alignment therewith and extending rearwardly therefrom past the rear wheels for sensing the height and density of the pile of the floor covering on which the cleaner rests.

A yet still further primary object of the present invention, in addition to each of the foregoing objects, is the provision of such a sensor foot or plate passing adjacent one of such rear wheels.

Yet still another primary object of the present invention, in addition to each of the foregoing objects, is the provision in such a carpet cleaner of a flexible connector between such sensor foot or plate and an indicator providing visual indication to an operator of the position of such sensor foot relative such rear wheel and, therefore, of the pile height and density.

Yet another and still further primary object of the present invention, in addition to each of the foregoing objects, is the provision of such a carpet cleaner wherein such flexible connection comprises a bowden type cable having an outer conduit mounted with the wheel axle for movement therewith and an inner wire core mounted with the sensor foot plate for movement therewith.

Yet still another and further primary object of the present invention, in addition to each of the foregoing objects, is the provision in such a carpet cleaner having such a bowden type cable flexible connector of an indicator assembly mounted to the cleaner chassis having a housing connected with the outer conduit providing a scale of carpet densities and a slider type indicator movable therewithin and connected with the inner wire core to thereby provide to an operator a visual indication of the relative position of the sensor foot or plate and, thereby, a visual indication of the carpet density and an appropriate setting for the nozzle height.

It is yet a further primary object of the present invention, in addition to each of the foregoing objects, to provide such a carpet pile density indicator and a cleaner incorporating the same which is economical to manufacture and durable and effective in use.

The invention resides in the combination, construction, arrangement and disposition of the various component parts and elements incorporated in improved carpet cleaners and pile density indicators therefore and incorporated therein and in methods of measuring and indicating floor covering pile density in accordance with the principles of this invention. While the present invention is described, disclosed, illustrated and shown as applied to an upright vacuum cleaner, it is to be expressly understood that the pile height and density sensor and indicator arrangement of the present invention may be used with cleaners of other types, such as nozzles and powered heads for tank type cleaners, central vacuum systems, and the like, and for other materials such as upholstery, and the like, and use in cleaners generally is explicitly intended to be covered hereby and in the claims. The present invention will be better understood and objects and important features other than those specifically enumerated above will become apparent when consideration is given to the following details and description which, when taken in conjunction with the annexed drawing describes, discloses, illustrates and shows a preferred embodiment or modification of the present invention and what is presently considered and believed to be the best mode of practicing the principles thereof. Other embodiments or modifications may be suggested to those having the benefit of the teachings herein, and such other embodiments or modifications are intended to be reserved, especially if they fall within the scope and spirit of the subjointed claims.

SUMMARY OF THE INVENTION

The present invention provides means associated with a carpet cleaner, or the like, having an adjustable nozzle height providing a multiple number of nozzle height positions, for automatically sensing the pile of the floor covering being cleaned and automatically indicating the appropriate nozzle height position for any specific floor covering upon which the cleaner is positioned by automatically measuring and indicating the pile height and density of such floor covering using a pile height and density sensor which is independent of the nozzle height position, that is, which gives a uniform reading for a specific floor covering pile height and density regardless of the nozzle height setting at the time of sensing. More particularly, a carpet cleaner having a nozzle adjusting mechanism including rear wheels mounted on off-set ends of a rear axle formed with a central portion journalled in the rear of the chassis, is provided with a pile height and density sensor foot or plate pivoted to such central portion or in axial alignment therewith and extending rearwardly therefrom past the rear wheels for sensing the height and density of the pile of the floor covering on which the cleaner rests and a flexible connector between such sensor foot or plate and an indicator providing visual indication to an operator of the position of such sensor foot relative such rear wheel and, therefore, of the pile height and density.

The flexible connection comprises a bowden type cable having an outer conduit mounted with the wheel axle for movement therewith and an inner wire core mounted with the sensor foot plate for movement therewith. The indicator assembly is mounted to the cleaner chassis and has a housing connected with the outer conduit providing a scale of carpet densities and a slider type indicator movable therewithin and connected with the inner wire core to thereby provide to an operator a visual indication of the relative position of the sensor foot or plate and, thereby, a visual indication of the carpet density and an appropriate setting for the nozzle height.

DESCRIPTION OF THE DRAWING

While the specification concludes with claims particularly pointing out and distinctly claiming the subject matter which is regarded as forming the present invention, it is believed the invention will be better understood from the following detailed description when taken in conjunction with the annexed drawing which discloses, illustrates and shows a preferred embodiment or modification of the present invention and what is presently considered and believed to be the best mode of practicing the principles thereof and wherein:

DETAILED DESCRIPTION OF THE INVENTION

Figure 1:
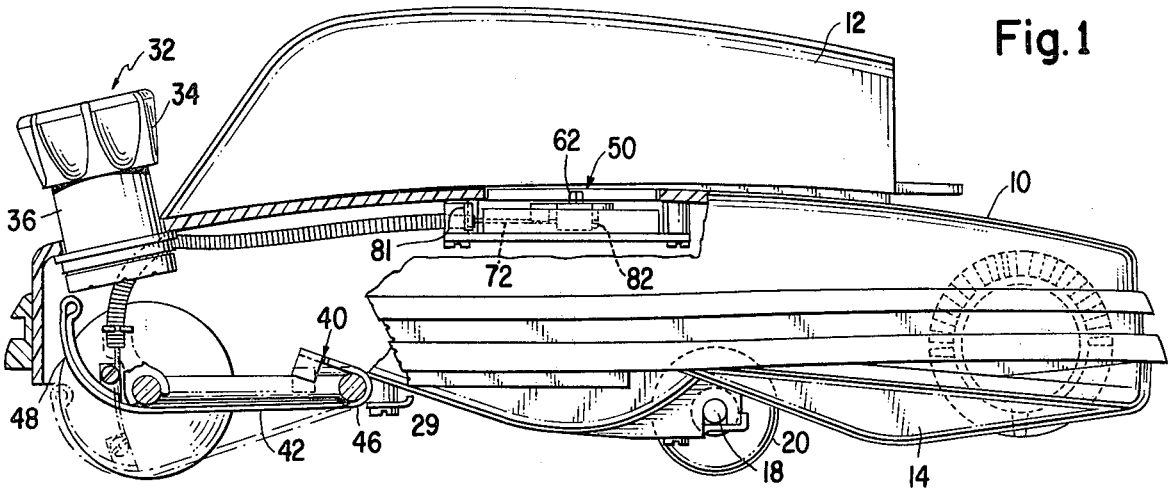
FIG. 1 is a side elevational view of the chassis of an upright or carpet cleaner vacuum sweeper with the handle removed, partially in section and including a pile height and density sensor and indicator arrangement in accordance with the present invention.
Figure 2:
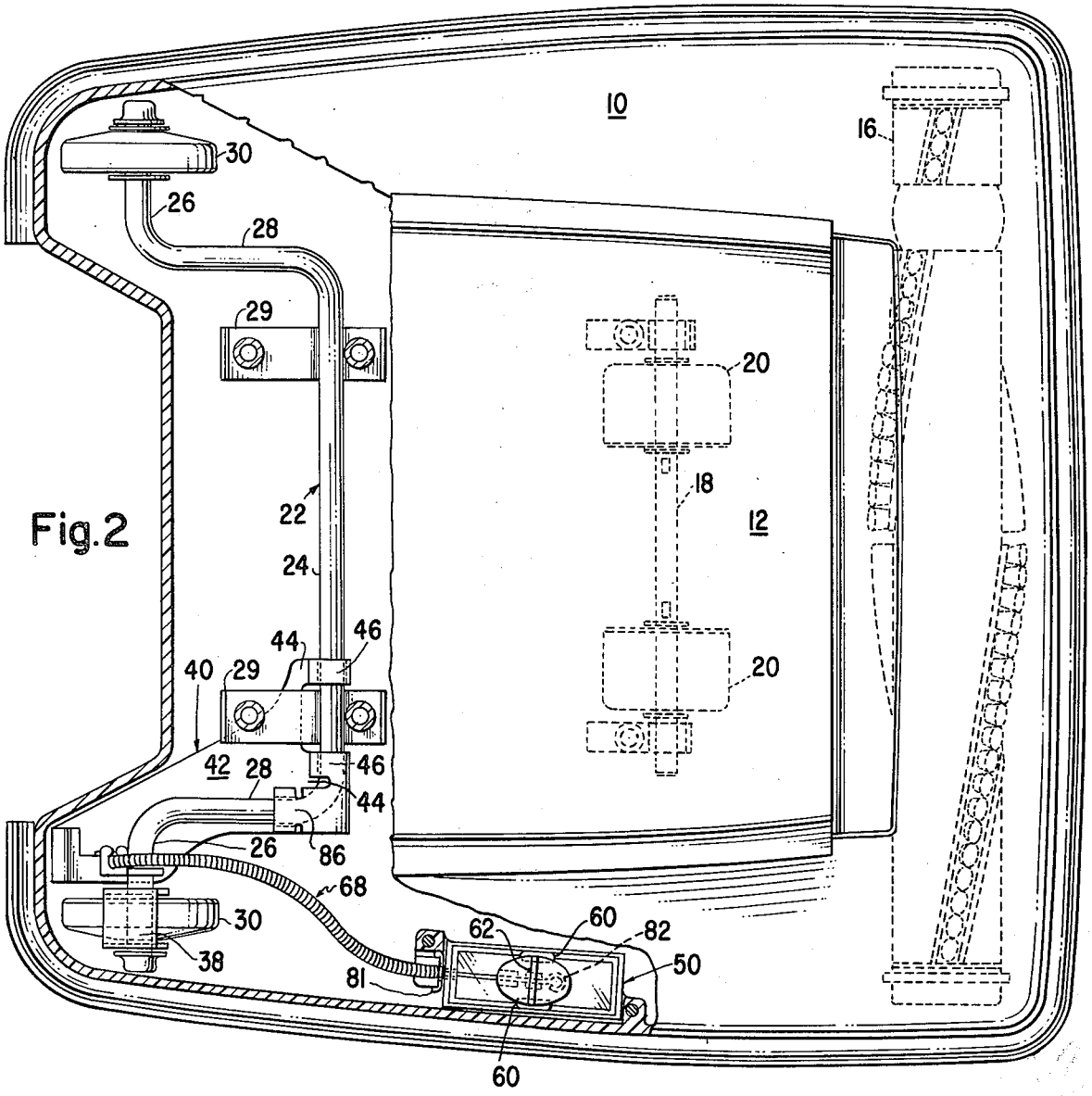
FIG. 2 is a plan view, partially broken away, of the cleaner of FIG. 1.
Figure 4:
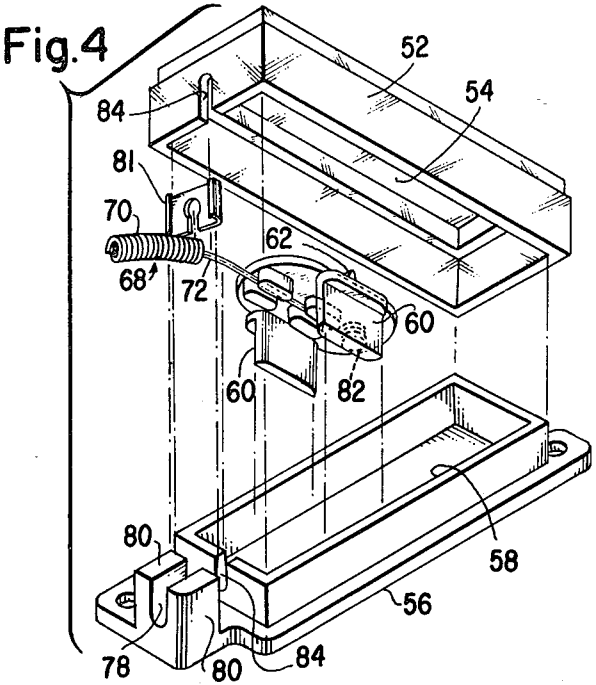
FIG. 4 is an exploded enlarged perspective view of the indicator and housing of the present invention.
Figure 3:
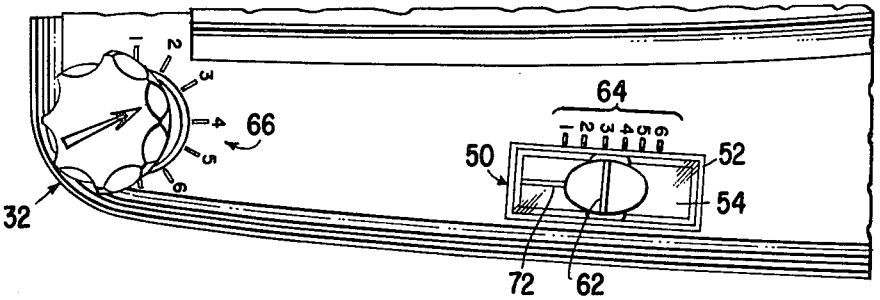
FIG. 3 is an enlarged partial view of the preceding figure showing the pile height and density indicator.
Figure 5:
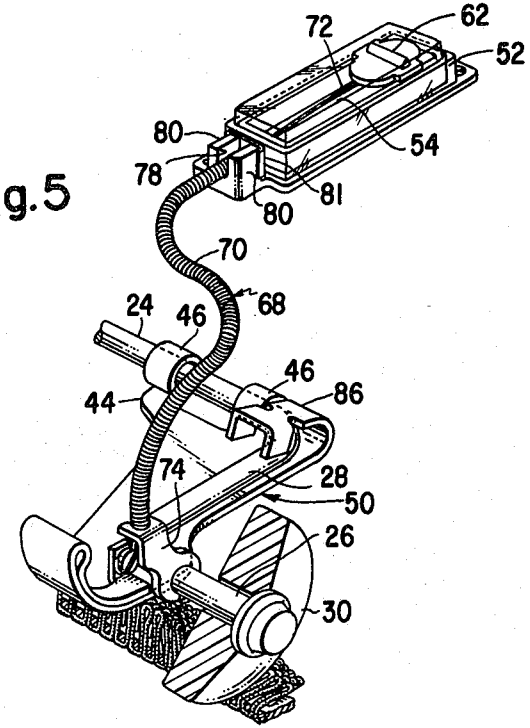
FIG. 5 is a perspective illustration of the pile density sensor and indicator arrangement of the present invention as applied to the carpet cleaner of the preceding figures, but with the chassis removed for clarity illustrating the sensor and indicator measuring a floor covering of high pile height and density.
Figure 6:
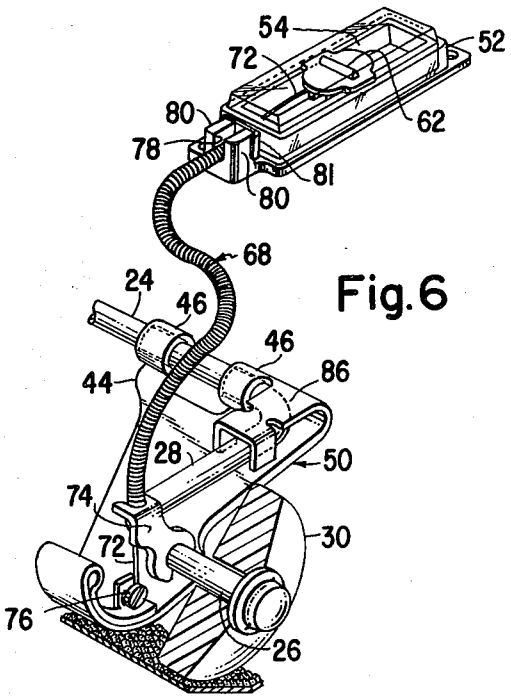
FIG. 6 is a perspective illustration similar to FIG. 5 but illustrating the sensor and indicator when the cleaner is on a floor covering of low pile height.

With reference now to the drawing, wherein like reference numerals denote similar parts throughout the various views, there is disclosed a substantial portion of a vacuum cleaner of the type known as a floor cleaner, or upright suction cleaner. A cleaner of this type is shown in its entirety in U.S. Pat. No. 3,163,439 dated Dec. 29, 1964, assigned to the same assignee as the present invention, and since the propelling handle, dust bag and motor-blower unit are conventional and form no part of the present invention and are not necessary for a clear understanding thereof, reference may be had to said patent for a full disclosure of the complete cleaner.

The vacuum cleaner includes a chassis 10 on the top of which is secured a hood 12. Mounted on the bottom of the chassis is an electric motor and a pair of fan impellers which communicate air through a discharge duct between the chassis, and access plate 14 and the hood, with the dust bag assembly. Reference may be had to the aforesaid U.S. Pat. No. 3,163,439, for a full disclosure of the motor, fans, and bag assembly. A vacuum cleaner inlet nozzle is formed in the access plate 14 and the forward portion at the bottom of the chassis and communicates the dirt lanen air with the fans. A rotary floor brush assembly 16 is mounted in the nozzle above the opening so as to contact the floor covering surface when a cleaner nozzle is at its proper elevation for the floor to be cleaned. Conventionally, a belt (not shown) drives the brush assembly from a spindle on the motor-fan shaft.

Mounted in a recess formed at the bottom of the chassis is a front wheel axis 18 which rotatably mounts a pair of wheels 20. A rear axle 22 including a central portion 24 having off-set leg portions 26 depending from respective crank arms 28, is journalled at the central portion on bearing recesses formed at the bottom of the chassis 10 and held in position therein by retaining straps 29, generally at the rear of the chassis 10. Rotatably mounted on the free extremity of each off-set leg 26 is a respective hollow interior rear wheel 30. As is well known in the prior art and as described in the aforesaid U.S. Pat. No. 3,163,439, turning of the rear axle 22 about the central portion 24 thereof results in the raising or lowering of the rear wheels 30 relative to the chassis 10. In other words, a lowering or raising of the chassis 10 and the nozzle relative to the rear wheels 30 results when the rear axle 22 is turned in its bearing seat while pivoting of the chassis 10 thereby around the front axle 18 raises or lowers, respectively the nozzle and brush 16.

Means for turning the rear axle 22 about the central portion 24 thereof and thereby raising or lowering the nozzle is also provided, designated generally by the reference character 32. This nozzle height adjusting mechanism or means for rotating the axle shaft 22 and, thereby, raising and lowering the nozzle height is shown in its entirety in the U.S. Pat. No. 4,083,079 dated Apr. 11, 1978, assigned to the same assignee as the present invention, and since the raising and lowering mechanism is conventional and forms no part of the present invention and is not necessary for a clear understanding thereof, reference may be had to said patent for a full disclosure of the complete raising and lowering mechanism. Further, other raising and lowering mechanisms such as, for example, the mechanism of the aforesaid U.S. Pat. No. 3,163,439 may be utilized.

The height adjusting mechanism 32 includes a knob 34 rotatable on a substantially cylindrical hollow locking member 36 mounted to the chassis 10. Within the hollow locking member 80, a pair of cooperating spiral members are provided, one of which is connected with the knob 34, the other of which is connected with a metal wheel bracket 38 which straddles one of the rear wheels 30 and is journalled on the associated one of the off-set legs 26 of the rear axle 22. As described in the aforesaid U.S. Pat. No. 4,083,079, rotation of the knob 34 is effective to raise and lower the metal bracket 38 and, therefore, the rear wheels 30.

Also journalled on the axle 22, specifically the central portion 24 thereof, is a pile height and density sensor plate designated generally by the reference character 40 for movement in a vertical plane which lies generally parallel and adjacent one of the rear wheels 30. The sensor plate or foot 40 may, for example, be formed of sheet metal having a generally planar central body portion 42 extending generally rearwardly from the axle 22, with the forward end portion of the planar portion 42 being bifurcated to clear the axle journal and retaining strap 29 and defining legs 44 on either side thereof, thereby longitudinally positioning the sensor plate or foot 40 on the central portion 24 of the rear axle 22. The bifurcations or legs 44 are formed into generally cylindrical wraps 46 extending generally loosely about the central portion 24 of the rear axle 22 to hingedly mount the sensor plate or foot 40 thereon. At the rear end portion of the central planar portion 42, the sensor plate or foot is formed into a generally arcuate smoothly rounded toe portion 48 so that the sensor plate or foot 40 may ride smoothly on the floor covering pile riding on top or slightly sinking into the pile adjacent the rear wheel 30 dependent upon the pile height and density or resilience.

As pointed out above, the mere visual appearance or subjective evaluation of the pile height is not always a sufficient indication of the total pile characteristics upon which to select the optimum nozzle height. The pile density and resilience, as also determined by pile spacing, type of pile, fiber content, backing and padding composition, and the like, also affects brush penetration and air flow through and around the pile. The penetration of the wheels and sensor plate or foot relative thereto, however, provides an objective means for measuring pile height and density as an integrated quantifier.

Since the sensor plate or foot 40 pivots on the central portion 24 of the rear axle 22, its angular relationship to the crank arm 28 is dependent only upon the pile height and density or resilience and is independent of the height adjustment of the rear wheels 30 so that its angular orientation to the crank arm 28 is an accurate indicator of the pile thickness or height and density which is independent of the nozzle height adjustment of the cleaner.

Due to the geometry, the distance from the off-set leg portion 26 of the rear axle 22 radially to the sensor plate or foot 40 perpendicular to the planar portion 42 thereof is directly proportional to the angle between the sensor plate or foot 40 and the crank arm 28 and is, therefore, also directly indicative of the pile height and density. In order to provide a visual indication of this distance and, therefore, the pile height and density, the chassis 10 of the cleaner is provided with an indicator assembly designated generally by the reference character 50, preferably in close proximity to the height adjusting mechanism 32 and at a location, such as the top of the chassis 10 foward of the height adjustment mechanism 32 where readily visible to the cleaner operator. The indicator assembly 50 comprises an upper housing 52 provided with a transparent window 54 that extends through a mating aperture on the upper surface of the chassis 10 and a lower housing 56 that mates with the upper housing 52 to provide a generally rectangular slideway 58 beneath the window 54. Contained within the slideway 58 is an indicator slide 60 which may be slid along the slideway 58 beneath the window 54 for visual observance therethrough. The slider 60 is provided with an indicator mark 62 visible through the window 54 and the upper surface of the chassis 10, adjacent the indicator 50 is provided with indicator markings to indicate the relative position of the slider 62. The marking may, for example, comprise a series of numbers corresponding to relative pile height and density indications which may be correlated with markings 66 provided in combination with the height adjusting mechanism 32.

In order to move the slider 60 within the slideway 58 under the influence of the sensor plate or foot 40, connection means of a flexible type, such as a bowden type cable 68 is provided for connecting the sensor assembly with the indicator assembly independently of the wheel height adjustment. The connector 68 comprises a flexible conduit 70 and a wire core 72 slidable therein. As heretofore pointed out, the perpendicular distance between the sensor plate or foot 50 and the off-set leg 26 is the distance that needs to be reflected in the relative position of the slider 60 within the slideway 58. Accordingly, one end of the conduit 70 is attached to the off-set leg 26 of the rear axle 22, as by means of a conduit connector 74 which engages the end portion of the conduit 70 and the off-set leg 26 while that end portion of the wire core 72 is connected with the sensor plate foot 50 as by means of a clamp 76 so that the wire core 72 will be moved within the conduit 70 only by relative movement of the sensor plate 50 relative the off-set leg 26 while movement of the off-set leg 26, corresponding to a change in height adjustment will result in movement of the entire end of the connector cable 68 and no relative movement between the conduit 70 and wire core 72.

At the indicator assembly end of the flexible connector 68, the conduit 70 is mounted with the housing 56 as by being pressed into a slot 78 provided between two upstanding posts 80 integrally formed with the lower housing 56 spaced from the end of the slideway 58 and held, as by a clamp 81. The wire core 72 is connected with the slider 60 as by a clamp 82. Clearance slots 84 are provided in the ends of the upper and lower housings 52 and 56, respectively providing clearance for the passage of the wire core 72 therethrough.

The sensor plate foot 50 be further provided with a stop tang 86 adjacent the wrap 46 for engaging the crank arm 28 to prevent excessive downward movement of the sensor plate foot 50 when, for example, the cleaner is lifted off the floor.

While the invention has been described, disclosed, illustrated and shown in terms of a preferred embodiment of modification, such other embodiments or modifications as may be suggested to those having the benefit of the teachings herein are intended to be reserved, especially as they fall within the scope and breadth of the claims here appended.

I claim:

1. A carpet cleaner comprising a chassis and a nozzle height adjusting mechanism including wheels mounted on offset ends of an axle formed with a central portion journalled in the chassis, a pile height and density sensor plate pivoted to such central portion and extending therefrom past the wheels for sensing the height and density of pile of the floor covering on which the cleaner rests.

2. Carpet cleaner defined in claim 1 wherein said sensor plate passes adjacent one of said wheels.

3. Carpet cleaner defined in claim 1, further comprising an indicator providing visual indication to an operator of the position of said sensor plate relative said wheels and, therefore, of the pile height and density and flexible means of sufficient buckling strength to transmit force in both directions for connecting said sensor plate to said indicator.

4. Carpet cleaner defined in claim 3 wherein said indicator is mounted to the cleaner chassis and comprises a housing providing a scale of carpet densities and a slider type indicator movable therewithin to provide to an operator a visual indication of the relative position of said sensor plate and, thereby, a visual indication of the carpet density and an appropriate setting for the nozzle height.

5. Carpet cleaner defined in claim 3 wherein said flexible means comprises a bowden type cable having an outer conduit mounted with said offset ends of said axle for movement therewith and an inner wire core mounted with said sensor plate for movement therewith.

6. Carpet cleaner defined in claim 5 wherein said indicator is mounted to the cleaner chassis and comprises a housing connected with said outer conduit providing a scale of carpet densities and a slider type indicator movable therewithin and connected with said inner wire core to thereby provide to an operator a visual indication of the relative position of said sensor plate and, thereby, a visual indication of the carpet density and an appropriate setting for the nozzle height.

7. Carpet cleaner defined in claim 3, 4, 5 or 6 further comprising nozzle height indicator means structurally associated with said nozzle height adjusting mechanism for indicating to the operator the actual nozzle height adjustment, said indicator providing visual indication to an operator of the position of said sensor plate relative said wheels and said nozzle height indicator means being constructed and arranged for visual correlation by the operator to together indicate to the operator when the appropriate nozzle height and the actual nozzle height correspond.

8. For use in a carpet cleaner having a chassis and a nozzle height adjusting mechanism including wheels mounted on offset ends of an axle formed with a central portion journalled in the chassis, a pile height and density sensor plate pivoted to such central portion and extending therefrom past one of said wheels for sensing the height and density of the pile of the floor covering on which the cleaner rests.

9. Apparatus defined in claim 8 further comprising an indicator providing a visual indication to an operator of the position of said sensor plate relative said one of said wheels and, therefore, of the pile height and density and flexible means of sufficient buckling strength to transmit force in both directions for connecting said sensor plate to said indicator.

10. Apparatus defined in claim 9 wherein said indicator comprises a housing providing a scale of carpet densities and a slider type indicator movable therewithin to provide to an operator a visual indication of the relative position of said sensor plate and, thereby, a visual indication of the carpet pile height and density and an appropriate setting for the nozzle height.

11. Apparatus claimed in claim 10 wherein said flexible means comprises a bowden type cable having an outer conduit mounted with one of said offset ends of said axle for movement therewith and an inner wire core mounted with said sensor plate for movement therewith.

12. Apparatus defined in claim 11 wherein said housing is connected with said outer conduit and said slider type indicator is connected with said inner wire core.

* * * * *